United States Patent [19]

Gjelstrup et al.

[11] Patent Number: 4,822,180

[45] Date of Patent: Apr. 18, 1989

[54] FOIL BAG

[75] Inventors: Lars Gjelstrup, Kolding; Flemming Hansen, Bjert, both of Denmark

[73] Assignee: Lindknud Plast A/S, Denmark

[21] Appl. No.: 138,093

[22] PCT Filed: Apr. 15, 1987

[86] PCT No.: PCT/DK87/00044

§ 371 Date: Dec. 16, 1987

§ 102(e) Date: Dec. 16, 1987

[87] PCT Pub. No.: WO87/06558

PCT Pub. Date: Nov. 5, 1987

[30] Foreign Application Priority Data

Apr. 22, 1986 [DK] Denmark ..... 1857/86

[51] Int. Cl.[4] ..... B65D 30/24

[52] U.S. Cl. ..... 383/57

[58] Field of Search ..... 383/44, 57

[56] References Cited

U.S. PATENT DOCUMENTS

| | | | |
|---|---|---|---|
| 2,800,269 | 7/1957 | Smith | 383/44 X |
| 2,804,257 | 8/1957 | Hasler et al. | 383/44 X |
| 3,189,252 | 6/1965 | Miller . | |
| 3,263,903 | 8/1966 | Waller et al. | 383/44 |
| 3,806,025 | 4/1974 | Marshall | 383/44 X |

FOREIGN PATENT DOCUMENTS

| | | |
|---|---|---|
| 0227683 | 5/1983 | Denmark . |
| 0129072 | 5/1984 | European Pat. Off. . |
| 1077360 | 5/1953 | France . |
| 0175570 | 8/1954 | Sweden . |
| 0855804 | 12/1958 | United Kingdom . |
| 1001872 | 8/1961 | United Kingdom . |
| 1109861 | 4/1965 | United Kingdom . |
| 2074983 | 5/1980 | United Kingdom . |

*Primary Examiner*—Stephen Marcus
*Assistant Examiner*—Nova Stucker
*Attorney, Agent, or Firm*—Darby & Darby

[57] ABSTRACT

In order to store liquid in a foil bag with no risk that liquid leaks from the bag, the bag is provided with a valve in the inlet channel (5). The valve consists of two valve flaps (8) formed by the foil by folding and at their sides being welded together in a weld seam (2) for the formation of the channel (5) extending from the outside to the inside of the bag. The weld seam (2) is at its center provided with a further welding in the shape of an extension (3) forming a narrowing in the cross section of the channel (5). When liquid is poured into the bag liquid will also flow into the hollow space between the outer foil (1) and the flap (8). Water will hereby distend these closed hollow spaces (7) and thereby press the flaps (8) against each other. This means that no liquid will escape through the flaps, and due to the narrowing in the channel the pressure creating the closure will be greatest opposite the narrowings (3).

2 Claims, 2 Drawing Sheets

FOIL BAG

Figure 1:
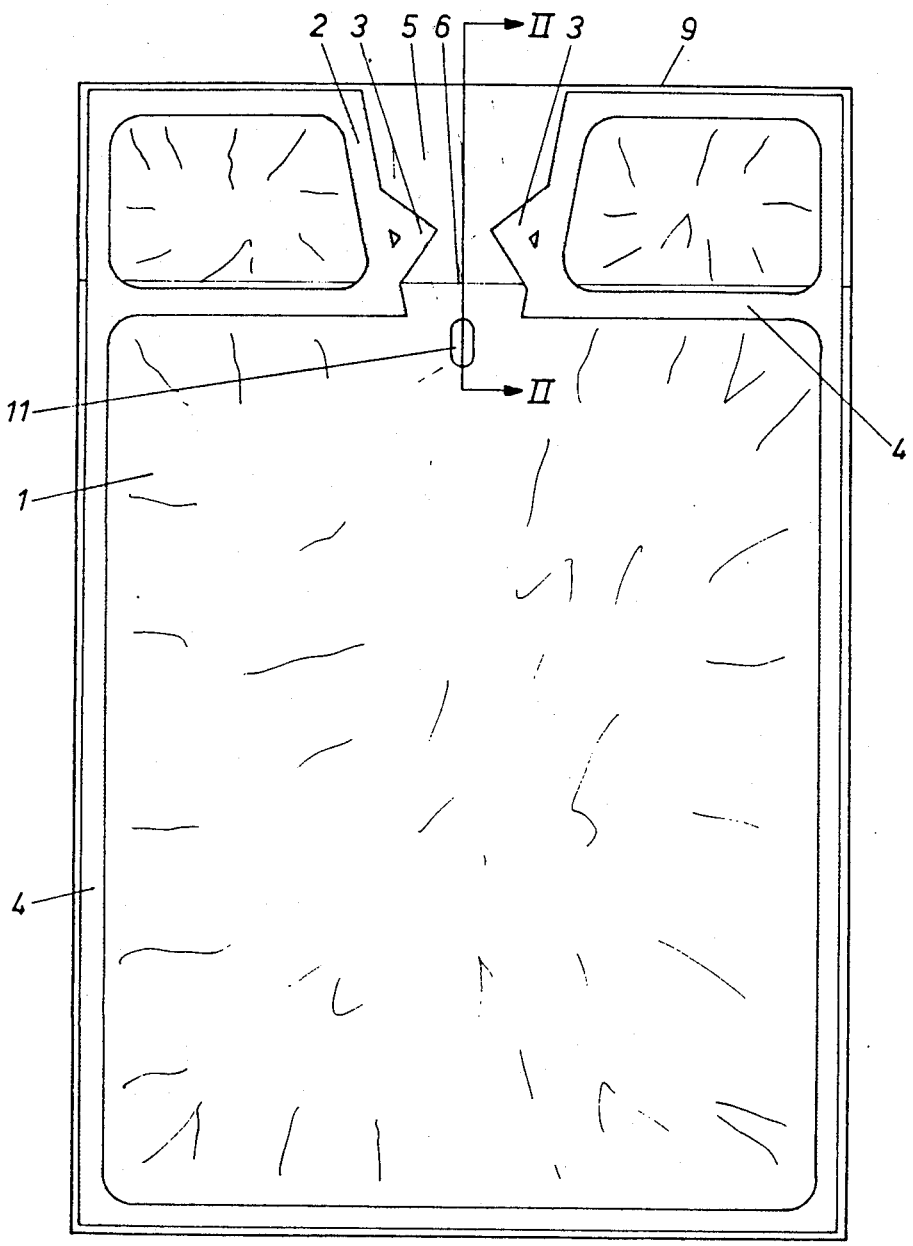

The invention relates to a foil bag, primarily for keeping a liquid, consisting of two welded-together foils with an inlet extending from the edge of the bag to its inside along a channel defined by the weld seams.

Bags of this type are used for keeping liquids, pastes and similar pumpable media, whether these be articles of food, technical products or the like.

Filling of the bag takes place by pouring liquid through an inlet channel, whereafter the channel is closed either by tying up the bag or by welding it together or by applying an adhesive tape around the inlet.

The bag with contents can, if so required, then be frozen and the bag later be emptied either by being torn open or by thawing it and letting out the liquid contents through the channel.

The disadvantage of these known bags is that they can only be closed by means of some subsequent shutting off of the inlet. This requires additional foil material or other auxiliary equipment, and moreover a considerable handling in order to close the bag in a completely liquid-proof manner.

It is the object of this invention to overcome these drawbacks of the known bags, and this is achieved in that the foils are folded towards the inside of the bag for the formation of two valve flaps in the channel, said valve flaps being welded together with the welding seams defining the channel for the formation of two pockets being open towards the inside of the bag and extending in all essentials in the entire length of the channel.

Hereby is achieved a self-closing valve, in that once the bag is filled, liquid will be pressed out between each valve flap and foil wall in the channel, which will distend the pockets. Hereby the two valve flaps will be pressed against each other for liquid-proof closing of the channel with no need for additional closing means or handling. Since the pockets are relatively big the surface of contact and hence the tightness degree will be very considerable so that a good and constant closing of the bag is achieved by means of these valve flaps which make up an integrated part of the bag.

Hereby the operating and handling of the bag is made easier, and the bag can be produced by machine in single pieces or in endless rolls. This makes the bag suitable for a disposable packing bag, because the manufacturing costs and material consumption can be kept relatively low.

When the liquid is to be let out from a filled bag, this may for instance be effected by inserting a pipe between the valve flaps, whereafter the liquid can move freely out through the pipe. The pipe can then be removed from the channel, and the bag will be closed when liquid is once again supplied to the pockets and distends these for tightening abutment against one another. This can normally be done by turning the bag upside down.

If the contents of the bag is frozen, the bag can be torn open in a usual manner and the contents be removed. Prior to being frozen, such a bag will thus be completely tightly closed in order that handling and storing in the freezer prior to the freezing can take place with no liquid leakage at all.

Moreover, the bag can be produced in such a manner that there is no air between the foil layers in order that the adding of liquid to the bag can take place without first evacuating the bag of air. This means that the cross section of the channel need not be particularly large which increases the degree of tightness of the valve flaps which do not cover each other over such a large area.

By, as referred to in claim 2, narrowing the channel, an efficient closing is achieved since the distension of the foil around the pockets during filling will cause tensions in the foil around the narrowing and thus increase the pressure on the valve flaps so that these are kept close together.

By, as referred to in claim 3, designing the narrowing with two pointed ends pointing towards each other, these tensions may be concentrated in an area near the centre of the channel and thereby the highest degree of tightness is obtained in just this area.

Finally it is expedient, as referred to in claim 4, to have the valve flaps extend a distance past the narrowing because the liquid flow to the pockets will not then be stopped when these are gradually being filled.

Figure 2:
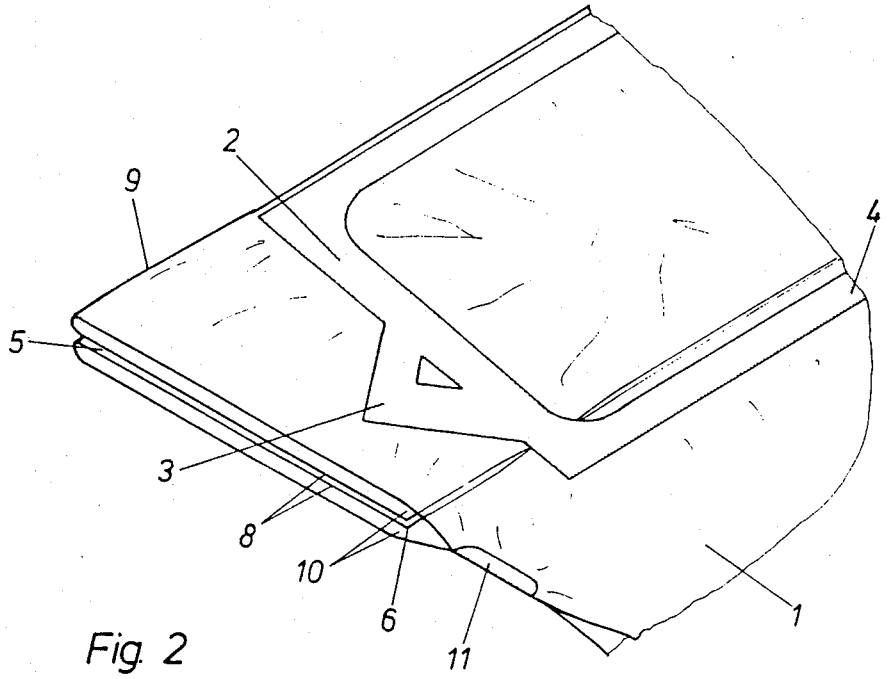
Figure 3:
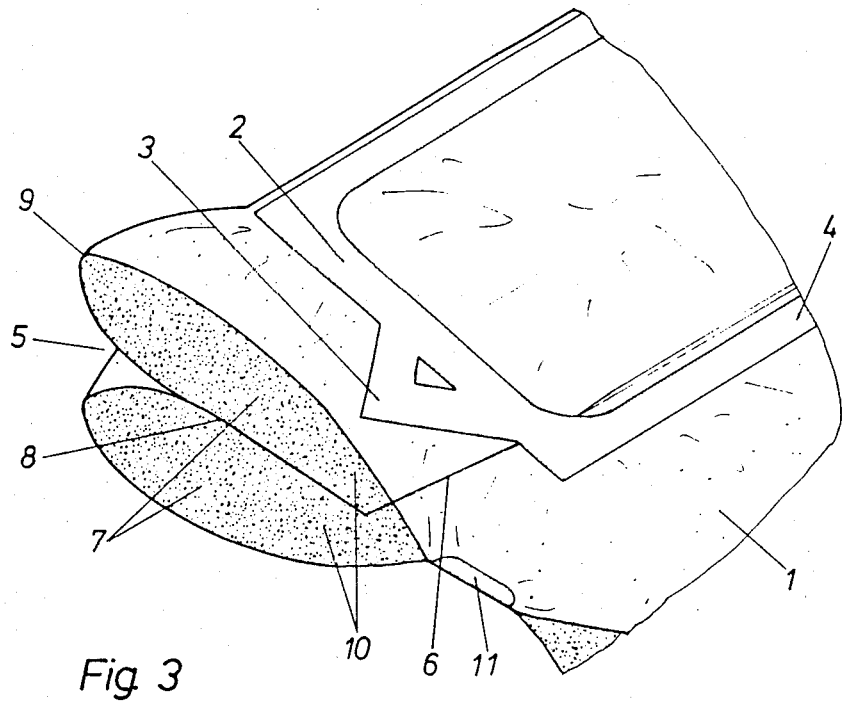

The invention will now be described in further detail with reference to the drawing, in which FIG. 1 shows a bag prior to being filled, FIG. 2 shows a section through the inlet channel in the direction along II—II in FIG. 1, and FIG. 3 shows the same section after the filling of the bag and with closed valve.

In the drawing is shown an example of an embodiment of a bag according to the invention. The bag is, as shown in FIG. 1, made of two foil layers 1, which at the top are folded along an edge 9 in order that the end edge 6 of the foil stops a distance down between the layers.

The foil layers are then welded together in order that a bag if formed with a weld 4 extending around it. At the top the weld stops in two closed rings leaving a channel 5 at the centre of the folded foils for the formation of the channel 5 shown in FIG. 2.

As is seen in FIG. 2, two foil layers are provided in the inside of the channel 5, at the top surface and bottom surface of the channel, respectively, which layers extend from the folding line 9 and a distance downwards.

The channel 5 is at its sides bounded by two weld seams 2 extending inwards in a sloping manner towards the centre of the bag and sloping towards each other.

Around the centre of the channel 5 two triangular weld seams 3 are provided, whose pointed ends point toward each other and being of a size which diminishes the width of the channel 5 by one half at this spot. The narrowing stops in the area around the foil edge 6 of the folded down foil.

Moreover, an additional weld seam 11 is provided opposite the centre of the inlet channel 5 in the bag 1, said seam extending parallel to the centre axis of the channel 5 and extending a short distance into the bag. This seam 11 serves the purpose of distributing the medium supplied through the channel into two flows which then fill the bag along the sides. This makes the filling of the bag quicker since filling primarily takes place from the outside and inwards.

When liquid is then added through the channel 5, e.g. by placing the channel around the spout of a water tap, the liquid will soon fill the bag entirely since it is empty of air.

When the bag is completely full of liquid, as shown in FIG. 3, the liquid will flow out into the two pockets 7 through passages 10 arranged between the valve flaps 8 formed by the foil and the outer foil 1.

The liquid will distend the pocket 7 in its entire size from the folding line 9 and inwards, which will press the valve flaps towards each other. Due to the narrowing 3 there will occur a heavy pull on the foils in this area particularly, which will result in a high abutment pressure between the flaps 8. The closure will thus be extra strong at the centre and then diminish evenly towards both sides of the channel. This will give an extremely expedient distribution of forces and ensure a completely reliable closure of the channel 5 so that no liquid can escape through the flaps 8 when the bag is full. The valve is furthermore self-regulating in that it will stay closed in proportion to the liquid pressure exerted from the inside of the bag. Pressure on the sides of the bags will thus not cause any leakage.

When liquid is to be led out a pipe (not shown) can be inserted between the flaps 8, and the liquid will then flow out through the pipe. The bag can then be filled again or closed by placing it with the inlet facing down because the liquid will then distend the pockets 7 and thereby close the channel.

If the bag is a freezer bag, it can be torn open and the frozen contents taken out.

Only seams formed by welding are mentioned above, but it is of course within the scope of the invention partly or in whole to replace this welding by glue in that glue can hold together the foil layers in the same manner as they would be were they heated.

The bag is thus completely self-closing, and it may be produced at the same costs as the hitherto known bags, but with such advantages as are offered by a self-closure. Since the valve is an integral part of the foil, faults cannot occur because the foil material, the dimensioning and the quality of the welds can satisfy any demands and requirements.

If required, the bag can be produced of foils which have different physical properties, such as light filter layers, liquid barrier layers, metal layers, etc. This means that the bag can be used for articles of food and other products which are either to be processed in the bag under heat or cold or to be protected against light and other types of radiation.

We claim:

1. A foil bag for storing liquid and pasty substances, the bag formed from two welded-together layers of foil having a channel defined by first welding seams, the channel extending from a rim of the bag to an interior thereof, the bag including a valve having two valve flaps disposed in the channel, the valve flaps being formed by folding the foil layers towards the interior of the bag and being closed by the first welding seams defining the channel for forming pockets which are open towards the interior of the bag, the foil bag characterized in that the pockets extend substantially the entire length of the channel, with the channel in cross-section having a shape of an hour glass produced by a narrowing in an area around a center of the channel.

2. A foil bag according to claim 1 further characterized in that the narrowing is formed by second welding seams which extend from the first weld seams on each side of the channel and converge in the direction toward the center of the channel for forming pointed ends pointing at each other and having a distance between them of half the width of the channel in the area of the center of its length.

* * * * *